US008654158B2

(12) United States Patent
Tsai et al.

(10) Patent No.: US 8,654,158 B2
(45) Date of Patent: Feb. 18, 2014

(54) PIXEL CIRCUIT RELATING TO ORGANIC LIGHT EMITTING DIODE AND DISPLAY USING THE SAME AND DRIVING METHOD THEREOF

(75) Inventors: Tsung-Ting Tsai, Tainan (TW); Chia-Ling Chou, Changhua County (TW)

(73) Assignee: Au Optronics Corporation, Hsinchu (TW)

( * ) Notice: Subject to any disclaimer, the term of this patent is extended or adjusted under 35 U.S.C. 154(b) by 289 days.

(21) Appl. No.: 12/917,488

(22) Filed: Nov. 2, 2010

(65) Prior Publication Data

US 2011/0254883 A1 Oct. 20, 2011

(30) Foreign Application Priority Data

Apr. 16, 2010 (TW) ..... 99111961 A

(51) Int. Cl.
*G09G 5/10* (2006.01)

(52) U.S. Cl.
USPC ..... 345/691; 345/211; 257/59; 257/E33.053

(58) Field of Classification Search
USPC ..... 345/691, 92, 211; 315/169.3
See application file for complete search history.

(56) References Cited

U.S. PATENT DOCUMENTS

| | | | | |
|---|---|---|---|---|
| 7,382,342 | B2 * | 6/2008 | Uchino et al. | 345/92 |
| 2005/0012736 | A1 | 1/2005 | Uchino et al. | |
| 2005/0287750 | A1 * | 12/2005 | Lee | 438/301 |
| 2007/0296651 | A1 | 12/2007 | Kim et al. | |
| 2008/0088546 | A1 | 4/2008 | Takasugi et al. | |
| 2009/0321741 | A1 * | 12/2009 | Sun | 257/59 |

OTHER PUBLICATIONS

"Office Action of Taiwan Counterpart Application", issued on Jun. 7, 2013, p. 1-p. 9.

* cited by examiner

*Primary Examiner* — Kevin M Nguyen
*Assistant Examiner* — Kenneth B Lee, Jr.
(74) *Attorney, Agent, or Firm* — Jianq Chyun IP Office

(57) ABSTRACT

A pixel circuit relating to an organic light emitting diode (OLED) and a display using the same and a driving method thereof are provided. The pixel circuit submitted by the present invention adopts a 3T2C architecture (i.e. three TFTs plus two capacitors), and which circuit topology being driven by the corresponding scan signals and data signal may make the luminance shown by the pixel circuit only relate to the data signal and do not relate to the threshold voltage of a transistor used to drive a lighting element (i.e. OLED), a system high voltage received by the pixel circuit, and a potential between an anode and a cathode of the lighting element, such that the problem of non-uniform displaying on the OLED display panel may be improved or resolved effectively.

14 Claims, 9 Drawing Sheets

Pix

Pix

PIXEL CIRCUIT RELATING TO ORGANIC LIGHT EMITTING DIODE AND DISPLAY USING THE SAME AND DRIVING METHOD THEREOF

CROSS-REFERENCE TO RELATED APPLICATION

This application claims the priority benefit of Taiwan application serial no. 99111961, filed on Apr. 16, 2010. The entirety of the above-mentioned patent application is hereby incorporated by reference herein and made a part of this specification.

BACKGROUND OF THE INVENTION

1. Field of the Invention

The present invention generally relates to a flat display technology, and more particularly, to a pixel circuit relating to an organic light emitting diode and a display using the same and a driving method thereof.

2. Description of Related Art

Since the years, the developments of the flat display technology are ceaselessly upgraded, wherein organic light emitting diodes (OLEDs), also named as organic electroluminescence (OEL), are used in the flat display technology and play an unique role uncompetitive by other technique as a new age technology and have many advantages including power-saving, ultra slim, light, self-luminescent, no limitation of angle of view (AOV), fast response, high photoelectric efficiency, without backlight structure and color filter structure, high contrast, high luminosity efficiency, high luminance, feasibility of realizing multi-color and RGB devices and wide operation temperature range. Therefore, OLEDs are seen as one of the most perspective flat display technologies.

The OLED display now can be roughly divided into a passive matrix OLED display (PMOLED display) and an active matrix OLED display (AMOLED display). The PMOLED display is driven mainly by using scan means/mechanism so as to produce high luminance. Consequently, the PMOLED display consumes higher power, the devices are easier to be degraded and the display is not suitable for high-resolution panel. The AMOLED display is driven mainly by using thin film transistors (TFTs) to associate with capacitors for storing different data signals, so as to control the grayscale of each pixel on the panel.

With an AMOLED display, after scanning, the pixels still keep the original luminance, and the AMOLED display does not need to drive for a very high luminance. In comparison with the PMOLED display, the AMOLED display has obvious advantages: better lifetime performance and high resolution. As a result, the current development is focused on the AMOLED display towards application in large-sized panel.

As shown by FIG. 1, the pixel circuit 100 of a traditional AMOLED display mostly adopts a 2T1C architecture, i.e., two TFTs T1 and T2 plus a capacitor C. In general speaking, the pixel circuit 100 is driven by a scan signal Vscan and a data signal Vdata to emit light, where the presented luminance thereof is proportional or inversely proportional to the intensity of the data signal Vdata.

In practical, since the high system voltage OVDD of each pixel circuit 100 in an AMOLED display is connected to each other, such that when each pixel circuit 100 is driven by the corresponding scan signal Vscan and data signal Vdata, the current flowing through the wire for transmitting the high system voltage OVDD would produce a voltage-dropping effect in association with the impedance the wire itself has. As a result, the high system voltage OVDD received by each pixel circuit 100 is different from each other.

In addition, under the influence of the process, the TFT T2 for driving the OLED OD in each pixel circuit 100 may have different threshold voltage Vth. Accordingly, based on the high system voltage OVDD received by each pixel circuit 100 is different and the threshold voltage Vth of the TFT T2 for driving the OLED OD in each pixel circuit 100 is not the same, such situations lead to that the currents flowing through the OLEDs OD of the pixel circuits 100 are different from each other even through assuming a same data signal Vdata is applied on each of the pixel circuits 100. Therefore, the luminance presented by each pixel circuit 100 is different, which is considered as the major factor of non-uniform displaying on the OLED panel.

SUMMARY OF THE INVENTION

Accordingly, the present invention is directed to a pixel circuit relating to an organic light emitting diode and a display using the same and a driving method thereof, which may effectively improve/resolve the problem of non-uniform displaying on the OLED panel.

The present invention provides a pixel circuit, which includes a first transistor, a second transistor, a third transistor, a first capacitor, a second capacitor and a lighting device (may be an OLED). The gate of the first transistor is for receiving a first scan signal, and the first drain/source of the first transistor is for receiving a data signal. The gate of the second transistor is for receiving a second scan signal, and the first drain/source of the second transistor is for receiving a reference signal. The first terminal of the first capacitor is electrically connected to the second drain/source of the first transistor, and the second terminal of the first capacitor is electrically connected to the second drain/source of the second transistor. The gate of the third transistor is electrically connected to the second drain/source of the first transistor, and the first drain/source of the third transistor is electrically connected to a first voltage, and the second drain/source of the third transistor is electrically connected to the second drain/source of the second transistor. The first terminal of the second capacitor is electrically connected to the first drain/source of the third transistor, and the second terminal of the second capacitor is electrically connected to the second drain/source of the third transistor. The first terminal of the lighting device is electrically connected to the second drain/source of the third transistor, and the second terminal of the lighting device is electrically connected to a second voltage.

In an embodiment of the present invention, the first terminal and the second terminal of the lighting device is respectively an anode and a cathode, and the first voltage and the second voltage are respectively a high system voltage and a low system voltage. In this case, the first transistor, the second transistor and the third transistor are respectively an N-type transistor.

In another embodiment of the present invention, the first terminal and the second terminal of the lighting device is respectively a cathode and an anode, and the first voltage and the second voltage are respectively a low system voltage and a high system voltage. In this case, the first transistor, the second transistor and the third transistor are respectively a P-type transistor.

The present invention also provides a display with the pixel circuit submitted by the present invention.

The present invention further provides a driving method suitable for driving the pixel circuit submitted by the present invention. The driving method includes, during a reset period in one frame period, resetting the voltage levels of the gate and the second drain/source of the third transistor; during a storing period in the same frame period, recording the threshold voltage of the third transistor; during a writing period in the same frame period, providing the data signal to the gate of the third transistor; and during a lighting period in the same frame period, making the lighting device to emit light in response to the data signal only.

Based on the depiction above, the pixel circuit submitted by the present invention adopts a 3T2C architecture (three TFTs plus two capacitors), and which circuit topology being driven by the corresponding scan signals and data signal may make the luminance shown by the pixel circuit only relate to the data signal and do not relate to the threshold voltage of a transistor used to drive a lighting element (i.e. OLED), a system high voltage received by the pixel circuit, and a potential between an anode and a cathode of the lighting element, such that the problem of non-uniform displaying on the OLED display panel may be improved or resolved effectively.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
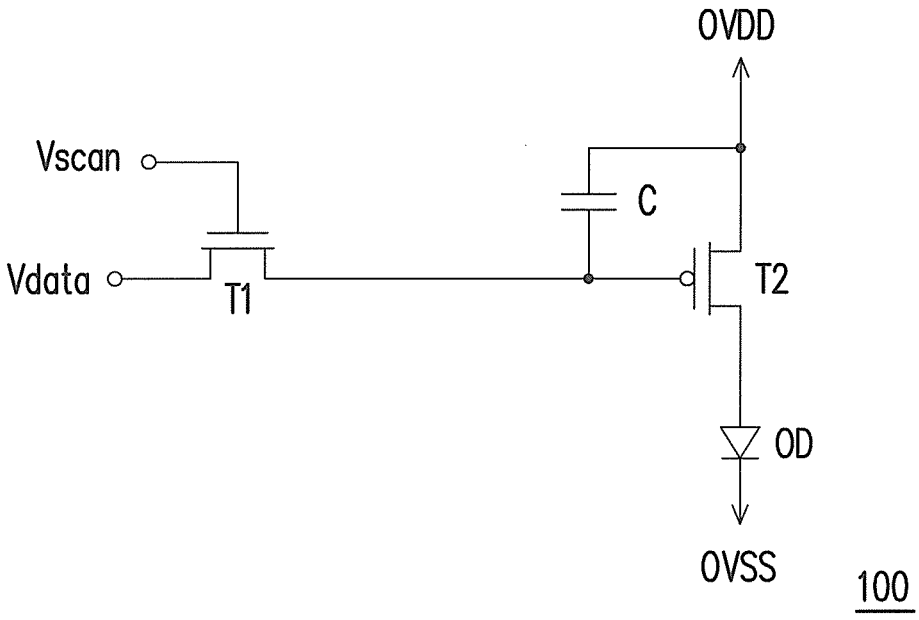
FIG. 1 (RELATED ART)
FIG. 1 is a diagram of a pixel circuit in a conventional AMOLED display.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
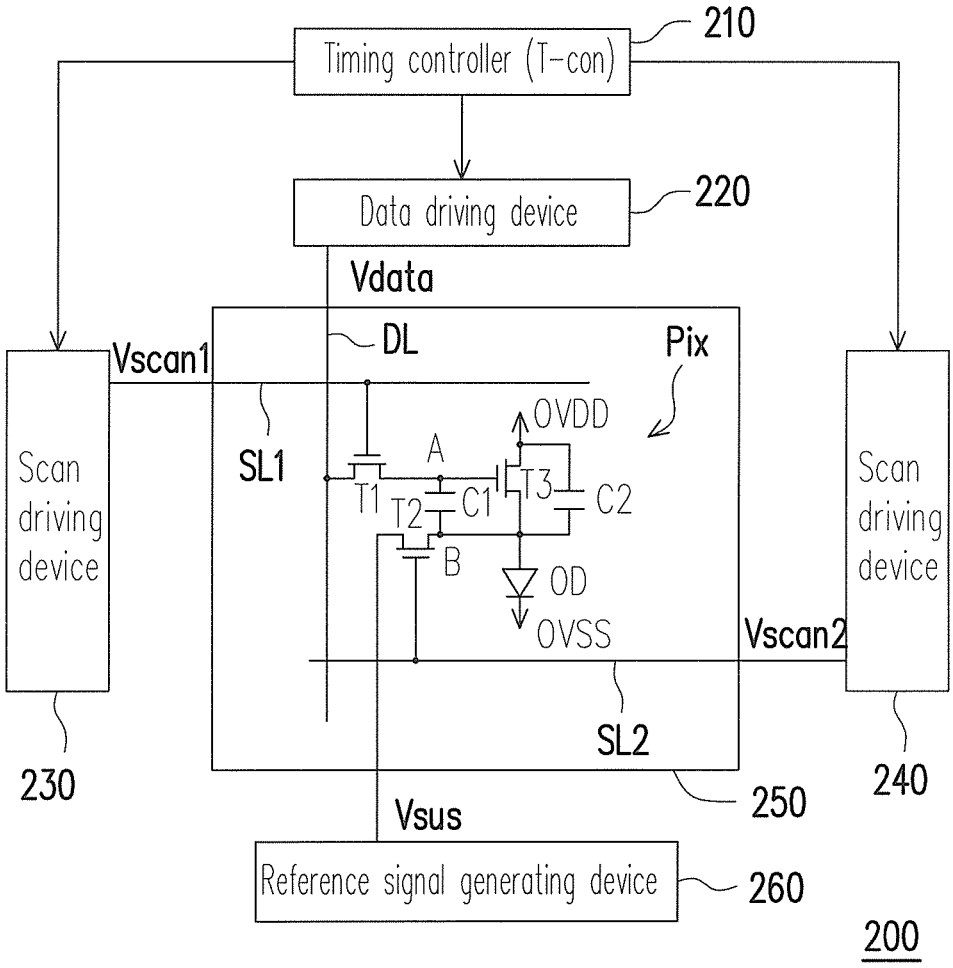
FIG. 2A is a system block diagram of an OLED display according to an embodiment of the present invention.

FIG. 2A is a system block diagram of an OLED display 200 according to an embodiment of the present invention. Referring to FIG. 2A, the OLED display 200 includes a timing controller (T-con) 210, a data driving device 220, scan driving devices 230 and 240, a display panel 250 and a reference signal generating device 260.

In the present embodiment, the display panel 250 includes at least a data line DL, at least two scan lines SL1 and SL2 and at least a pixel circuit Pix. The data line DL is electrically connected to the data driving device 220 for receiving a data signal Vdata provided by the data driving device 220 which is controlled by the T-con 210. The scan line SL1 is electrically connected to the first scan driving device 230 for receiving a scan signal Vscan1 provided by the scan driving device 230 which is controlled by the T-con 210. The scan line SL2 is electrically connected to the scan driving device 240 for receiving a second scan signal Vscan2 provided by the scan driving device 240 which is controlled by the T-con 210.

On the other hand, the pixel circuit Pix includes transistors T1-T3 (for example, TFTs), capacitors C1 and C2 and a lighting device OD, wherein the transistors T1-T3 are N-type transistors and the lighting device OD is an OLED. In the present embodiment, the gate of the N-type transistor T1 is electrically connected to the scan line SL1 to receive the scan signal Vscan1, while the drain of the N-type transistor T1 is electrically connected to the data line DL to receive the data signal Vdata. The gate of the N-type transistor T2 is electrically connected to the scan line SL2 to receive the scan signal Vscan2, while the drain of the N-type transistor T2 is for receiving a reference signal Vsus provided by the reference signal generating device 260.

The first terminal of the capacitor C1 is electrically connected to the source of the N-type transistor T1, while the second terminal of the capacitor C1 is electrically connected to the source of the N-type transistor T2. The gate of the N-type transistor T3 is electrically connected to the source of the N-type transistor T1, while the drain of the N-type transistor T3 is electrically connected to the high system voltage OVDD, while the source of the N-type transistor T3 is electrically connected to the source of the N-type transistor T2. The first terminal of the capacitor C2 is electrically connected to the drain of the N-type transistor T3, while the second terminal of the capacitor C2 is electrically connected to the source of the N-type transistor T3. The anode of the lighting device OD is electrically connected to the source of the N-type transistor T3, while the cathode of the lighting device OD is electrically connected to the low system voltage OVSS.

Based on the depiction above, the operation of the pixel circuit Pix can be described in details as follows, which may be referred to one person having ordinary skilled in the art.

Figure 2B:
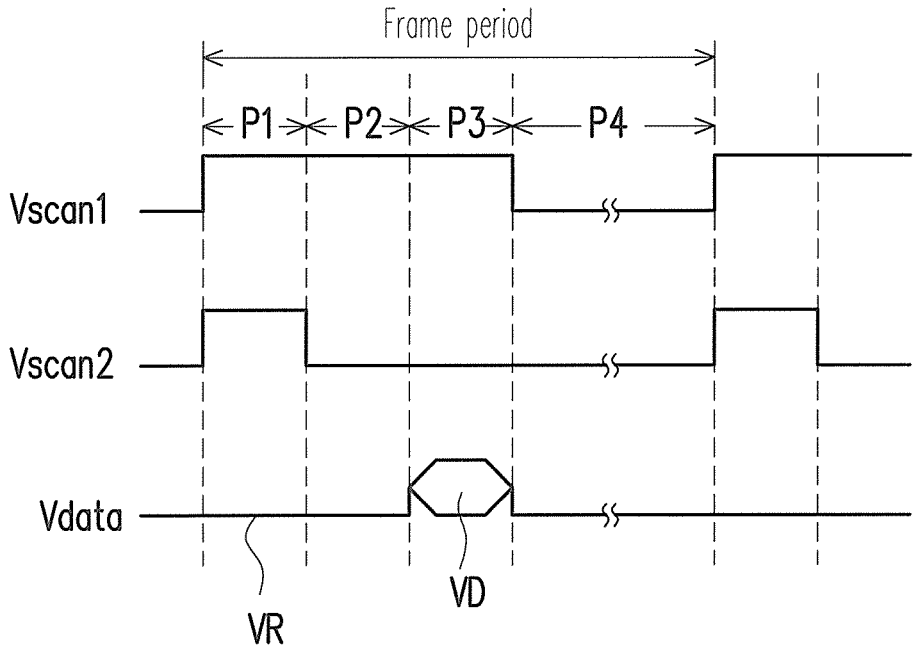
FIG. 2B is a driving waveform diagram of the pixel circuit of FIG. 2A.

FIG. 2B is a driving waveform diagram of the pixel circuit of FIG. 2A and FIGS. 3A-3D are operation diagrams of the pixel circuit of FIG. 2A. Referring to FIG. 2B, in the present embodiment, one frame period of the OLED display 200 is composed of a reset period P1 , a storing period P2, a writing period P3 and a lighting period (emission period) P4.

Figure 3A:
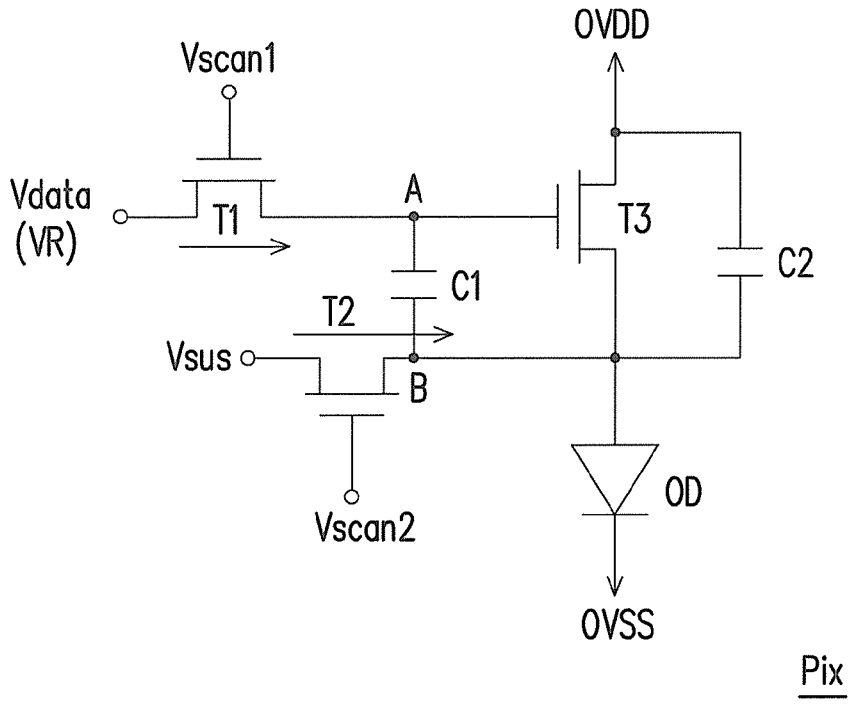
FIGS. 3A-3D are operation diagrams of the pixel circuit of FIG. 2A.

Referring to FIGS. 2B and 3A, during the reset period P1, the scan signals Vscan1 and Vscan2 are enabled so that the N-type transistors T1 and T2 are turned on. At this time, the data driving device 220 provides the data signal Vdata with the reference voltage VR to the pixel circuit Pix so as to pre-charge the pixel circuit Pix and to reset the voltage level of the gate of the N-type transistor T3. On the other hand, the reference signal generating device 260 provides the reference signal Vsus to the pixel circuit Pix so as to reset the voltage level of the source of the N-type transistor T3, wherein the voltage level of the reference voltage VR is greater than the voltage level of the reference signal Vsus. Accordingly, the voltage level of the node A (i.e., the voltage of the gate of the N-type transistor T3) is equal to the voltage level of the reference voltage VR, while the voltage level of the node B (i.e., the voltage of the source of the N-type transistor T3) is equal to the voltage level of the reference signal Vsus.

Figure 3B:
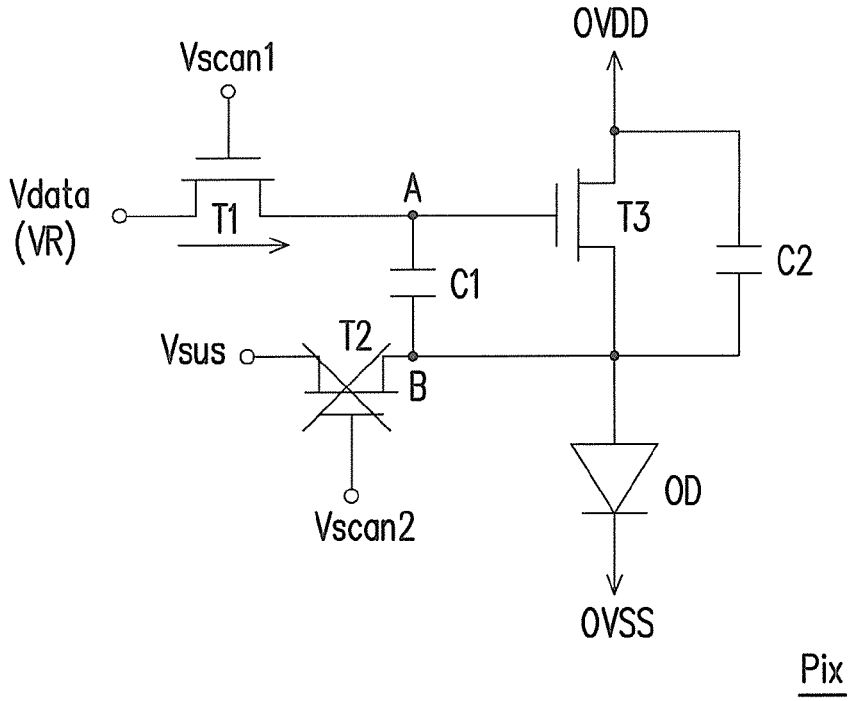

After that, referring to FIGS. 2B and 3B, during the storing period P2, the scan signals Vscan1 and Vscan2 are respectively enabled and disabled, so that the N-type transistor T1 is still turned on but the N-type transistor T2 is changed to be turned off. At this time, since the data driving device 220 continues to provide the data signal Vdata with the reference voltage VR to the pixel circuit Pix, so that the voltage level of the node A is equal to the voltage level of the reference voltage VR, while the voltage level of the node B is equal to VR-Vth, and the capacitor C1 thereby records the threshold voltage (Vth) of the N-type transistor T3, wherein VR of (VR-Vth) is the voltage level of the reference voltage VR and Vth of (VR-Vth) is the threshold voltage of the N-type transistor T3.

Figure 3C:
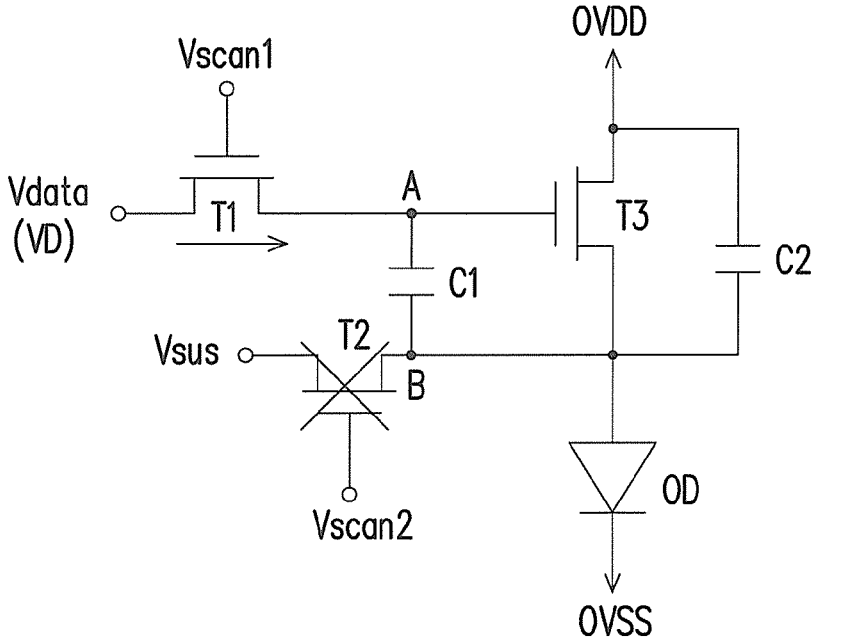

Further, referring to FIGS. 2B and 3C, during the writing period P3, the scan signals Vscan1 and Vscan2 are respectively enabled and disabled, so that the N-type transistor T1 is still turned on while the N-type transistor T2 is maintained to be turned off At this time, since the data driving device 220 in turn provides the data signal Vdata with the data voltage VD to the pixel circuit Pix (i.e., provides the data signal Vdata with the data voltage VD to the gate of the N-type transistor T3), so that the voltage level of the node A is changed to the voltage level of the data voltage VD, while the voltage level of the node B is equal to VR-Vth+a*(VD-VR), wherein a=C1/(C1+C2), C1 is the capacitance of the capacitor C1, C2 is the capacitance of the capacitor C2 and VD is the voltage level of the data voltage VD.

Figure 3D:
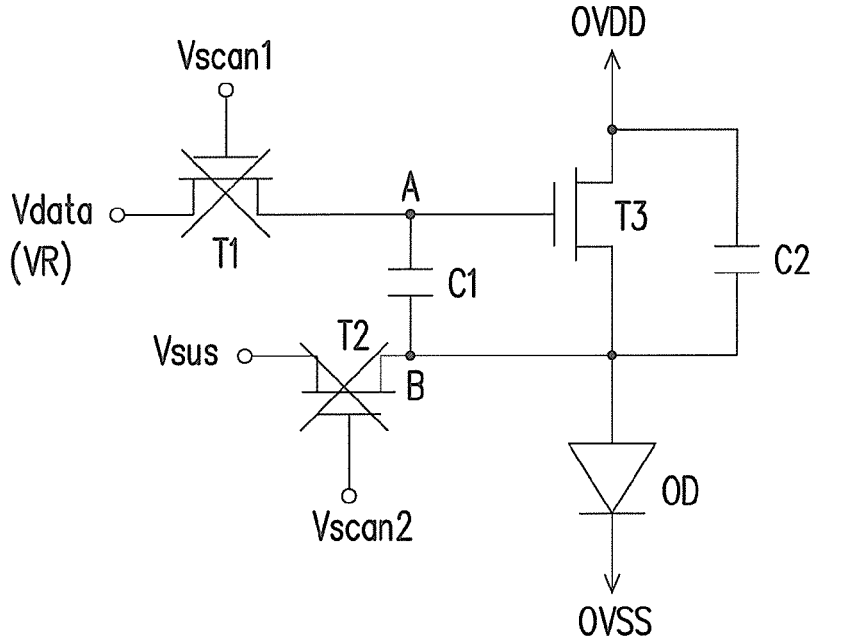

Finally, referring to FIGS. 2B and 3D, during the lighting period P4, the scan signals Vscan1 and Vscan2 are disabled, so that the N-type transistors T1 and T2 are turned off. At this time, the voltage level of the node A is equal to VD+Voled+OVSS-a*(VD-VR)+Vth-VR, while the voltage level of the node B is equal to Voled+OVSS, wherein Voled is the voltage drop across the anode and the cathode of the lighting device OD. Accordingly, the current flowing through the lighting device OD is equal to $K*[(1-a)*(VD-VR)]^2$, where K is a process parameter related to the N-type transistor T3 and usually is a constant.

It can be seen from the depiction above, during the lighting period P4, the current flowing through the lighting device OD is only related to the data signal Vdata with the reference voltage VR and the data voltage VD (i.e., the lighting device OD is made to light in response to the data signal Vdata only), and does not relate to the threshold voltage (Vth) of the N-type transistor T3 which is used for driving the the lighting device OD, the received high system voltage OVDD and the voltage drop (Voled) across the anode and the cathode of the lighting device OD in the pixel circuit Pix. As a result, the pixel circuit Pix of the present embodiment can effectively improve/resolve the problem of non-uniform displaying on the OLED panel 250.

The pixel circuit Pix of the above embodiment is realized by employing three N-type transistors T1-T3 and two capacitors C1 and C2, which the present invention is not limited thereto.

Figure 4A:
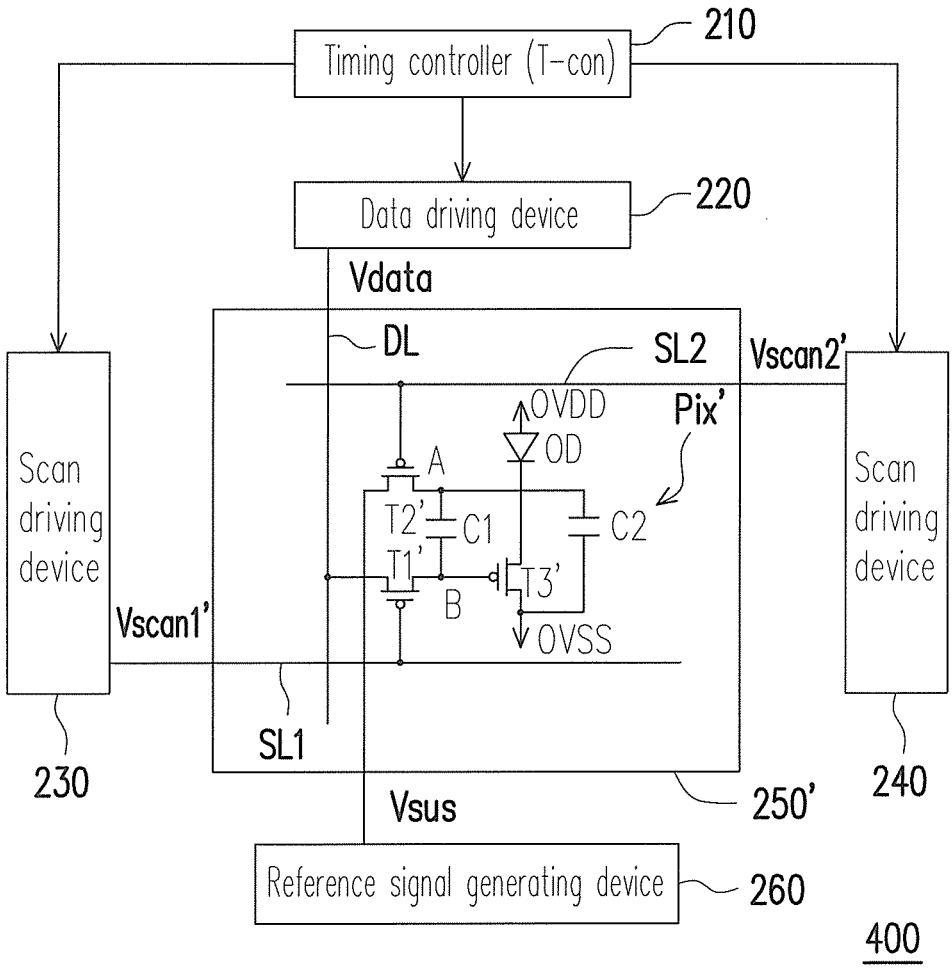
FIG. 4A is a system block diagram of an OLED display according to another embodiment of the present invention.
Figure 4B:
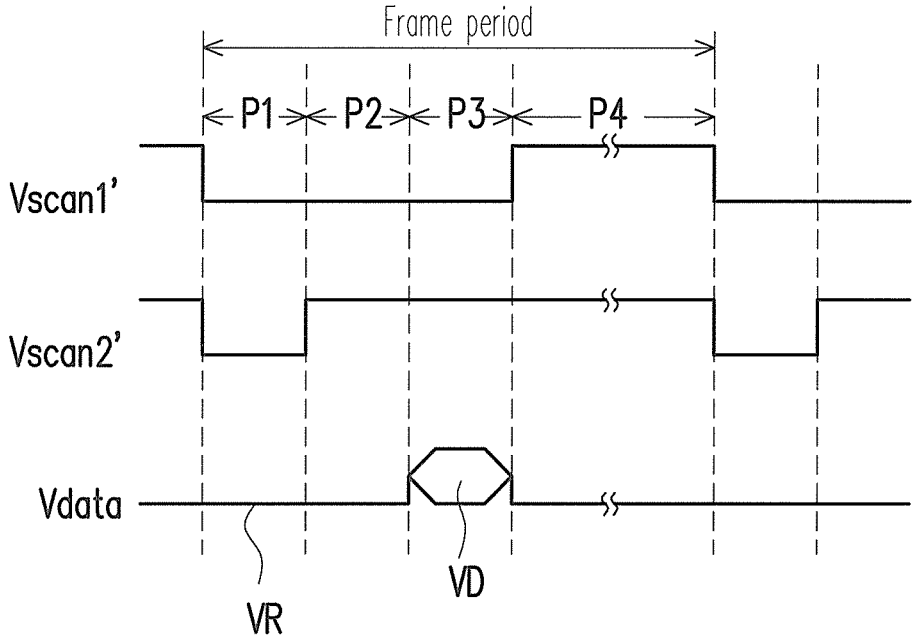
FIG. 4B is a driving waveform diagram of the pixel circuit of FIG. 4A.

FIG. 4A is a system block diagram of an OLED display 400 according to another embodiment of the present invention and FIG. 4B is a driving waveform diagram of the pixel circuit Pix' of FIG. 4A. Referring to FIGS. 4A and 4B, the difference between the OLED displays 200 and 400 rests in that the structures of the display panels 250 and 250' are different from each other. In the present embodiment, the pixel circuit Pix' in the display panel 250' and the pixel circuit Pix in the display panel 250 are complementary structures to each other. In more details, the pixel circuit Pix' is realized by employing three P-type transistors T1-T3 and two capacitors C1 and C2, so that the present embodiment can obtain the technical function similar to or the same as the above-mentioned embodiment when making the scan signals Vscan1 and Vscan2 of FIG. 2B reversed to the scan signals Vscan1' and Vscan2' of FIG. 4B to drive the pixel circuit Pix', which is omitted to describe herein.

On the other hand, the above-mentioned embodiment, for example, uses two scan driving devices 230 and 240 to respectively provide the scan signals Vscan1 (or Vscan1') and Vscan2 (or Vscan2') to drive the N-type transistors T1 and T2 (or P-type transistors T1' and T2'), which the present invention is not limited thereto.

Figure 5A:
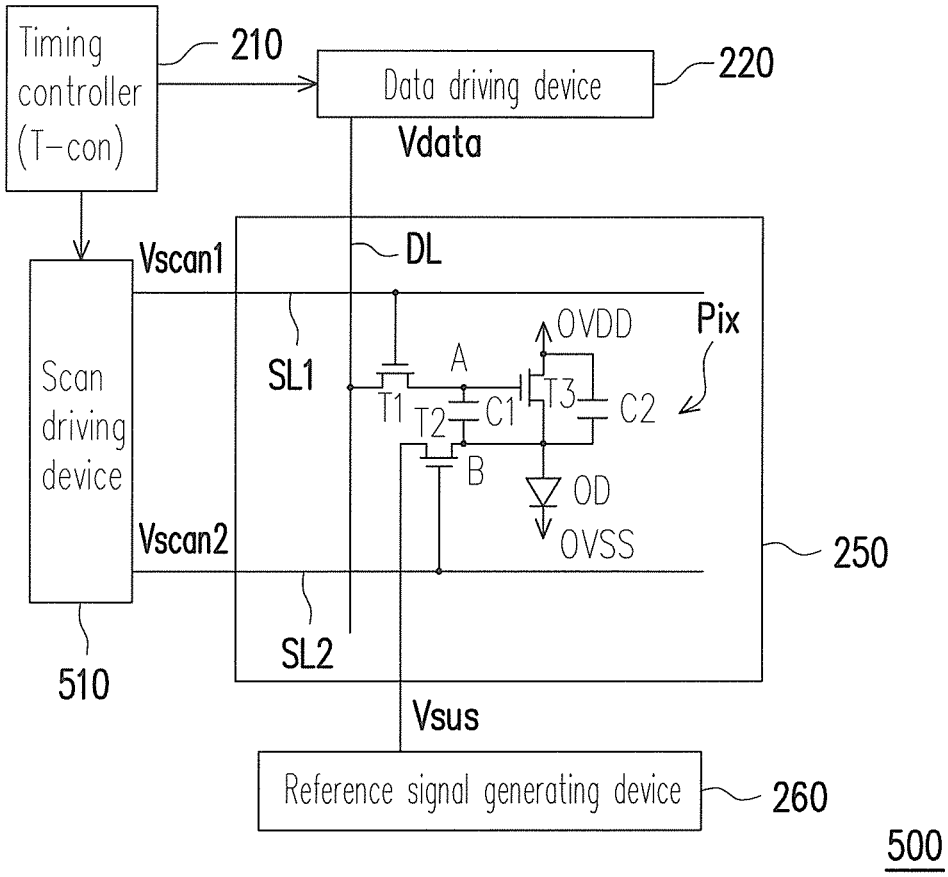
FIG. 5A is a system block diagram of an OLED display according to yet another embodiment of the present invention.
Figure 5B:
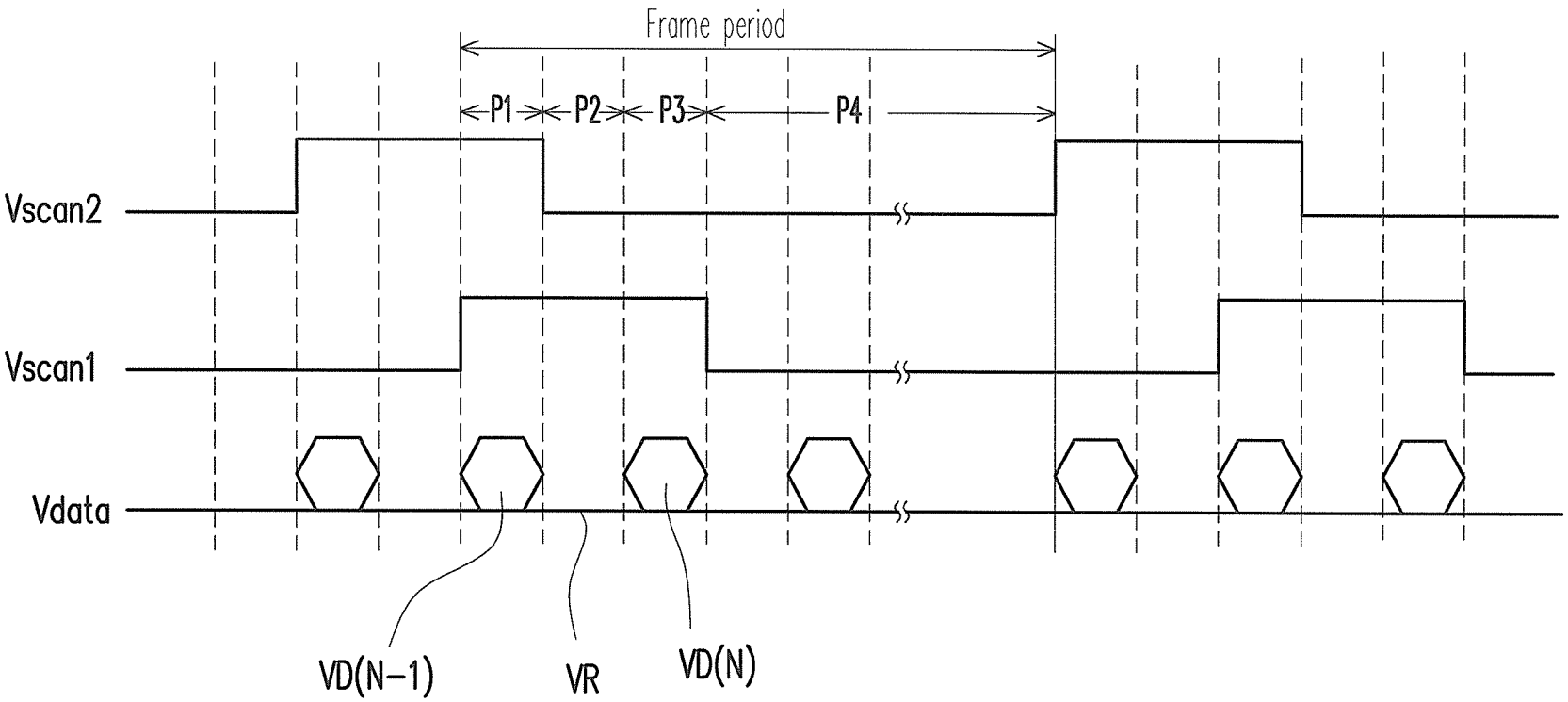
FIG. 5B is a driving waveform diagram of the pixel circuit of FIG. 5A

FIG. 5A is a system block diagram of an OLED display according to yet another embodiment of the present invention and FIG. 5B is a driving waveform diagram of the pixel circuit Pix of FIG. 5A. Referring to FIGS. 5A and 5B, the difference between the OLED displays 200 and 500 rests in that the OLED display 500 has a scan driving device 510 only, and the scan driving device 510 can use any one of the current available shift-register mechanism to produce the scan signals Vscan1 and Vscan2. In this way, the scan driving device 510 can be realized easier than the scan driving devices 230 and 240, and it costs less as well.

In the present embodiment, by means of the scan signals Vscan1 and Vscan2 provided by the scan driving device 510 and the data signal Vdata provided by the data driving device 220 to drive the pixel circuit Pix, then the similar or the same function as the above-mentioned embodiments can be obtained, which is omitted to describe herein.

However, it should be noted that if adopting the scan signals Vscan1 and Vscan2 and the data signal Vdata as shown in FIG. 5 to drive the pixel circuit Pix, the only difference compared to the driving result of FIG. 2B rests in that during the reset period P1, the voltage level of the node A is equal to the voltage level of the data signal Vdata with the data voltage VD(N-1) rather than the voltage level of the reference voltage VR of the above-mentioned embodiment. Besides, during the other periods P2-P4, the voltage levels of the nodes A and B are the same as the above-mentioned embodiment. In FIG. 5B, the notation VD(N-1) represents the data voltage of the previous data signal Vdata and the notation VD(N) represents the data voltage of the current data signal Vdata.

In summary, the pixel circuit (Pix/Pix') adopts a 3T2C architecture (i.e. three TFTs plus two capacitors), and which circuit topology being driven by the corresponding scan signals (i.e. Vsan1/Vscan1' and Vscan2/Vscan2') and data signal (Vdata) may make the luminance shown by the pixel circuit only relate to the data signal and do not relate to the threshold voltage of a transistor used to drive a lighting element (i.e. OLED), a system high voltage (OVDD) received by the pixel circuit, and a potential (Voled) between an anode and a cathode of the lighting element (i.e. the voltage drops (Voled) across the anode and the cathode of the lighting device), such that the problem of non-uniform displaying on the OLED display panel may be improved or resolved effectively.

It will be apparent to those skilled in the art that the descriptions above are several preferred embodiments of the present invention only, which does not limit the implementing range of the present invention. Various modifications and variations can be made to the structure of the present invention without departing from the scope or spirit of the invention.

What is claimed is:

1. A pixel circuit, comprising:

a first transistor, having a gate receiving a first scan signal, and a first drain/source receiving a data signal;

a second transistor, having a gate receiving a second scan signal, and a first drain/source receiving a reference signal;

a first capacitor, having a first terminal electrically connected to a second drain/source of the first transistor, and a second terminal electrically connected to a second drain/source of the second transistor;

a third transistor, having a gate electrically connected to the second drain/source of the first transistor, a first drain/source electrically connected to a first voltage, and a second drain/source electrically connected to the second drain/source of the second transistor;

a second capacitor, having a first terminal electrically connected to the first drain/source of the third transistor, and a second terminal electrically connected to the second drain/source of the third transistor, wherein the second capacitor is only connected to both the first drain/source and the second drain/source of the third transistor; and a lighting device, having a first terminal electrically connected to the second drain/source of the third transistor, and a second terminal electrically connected to a second voltage, wherein the third transistor is configured to drive the lighting device in response to a cross voltage of the first capacitor.

2. The pixel circuit as claimed in claim 1, wherein the first terminal and the second terminal of the lighting device are respectively an anode and a cathode, and the first voltage and the second voltage are respectively a high system voltage and a low system voltage.

3. The pixel circuit as claimed in claim 2, wherein the first transistor, the second transistor and the third transistor are respectively an N-type transistor.

4. The pixel circuit as claimed in claim 1, wherein the first terminal and the second terminal of the lighting device are respectively a cathode and an anode, and the first voltage and the second voltage are respectively a low system voltage and a high system voltage.

5. The pixel circuit as claimed in claim 4, wherein the first transistor, the second transistor and the third transistor are respectively a P-type transistor.

6. A display, comprising:

a display panel, comprising:

at least a data line, for receiving a data signal;

at least a first scan line and a second scan line, for respectively receiving a first scan signal and a second scan signal; and at least a pixel circuit, comprising:

a first transistor, having a gate electrically connected to the first scan line, and a first drain/source electrically connected to the data line;

a second transistor, having a gate electrically connected to the second scan line, and a first drain/source receiving a reference signal;

a first capacitor, having a first terminal electrically connected to a second drain/source of the first transistor, and a second terminal electrically connected to a second drain/source of the second transistor;

a third transistor, having a gate electrically connected to the second drain/source of the first transistor, a first drain/source electrically connected to a first voltage, and a second drain/source electrically connected to the second drain/source of the second transistor;

a second capacitor, having a first terminal electrically connected to the first drain/source of the third transistor, and a second terminal electrically connected to the second drain/source of the third transistor, wherein the second capacitor is only connected to both the first drain/source and the second drain/source of the third transistor; and a lighting device, having a first terminal electrically connected to the second drain/source of the third transistor, and a second terminal electrically connected to a second voltage, wherein the third transistor is configured to drive the lighting device in response to a cross voltage of the first capacitor.

7. The display as claimed in claim 6, further comprising:

a data driving device, electrically connected to the data line, for providing the data signal.

8. The display as claimed in claim 6, further comprising:

a first scan driving device, electrically connected to the first scan line, for providing the first scan signal; and a second scan driving device, electrically connected to the second scan line, for providing the second scan signal.

9. The display as claimed in claim 6, further comprising:

a scan driving device, electrically connected to the first scan line and the second scan line, for providing the first scan signal and the second scan signal.

10. A driving method, suitable for driving the pixel circuit as claimed in claim 1, the method comprising:

during a reset period in a frame period, resetting voltage levels of the gate and the second drain/source of the third transistor;

during a storing period in the frame period, recording a threshold voltage of the third transistor;

during a writing period in the frame period, providing the data signal to the gate of the third transistor; and during a lighting period in the frame period, making the lighting device to emit light in response to the data signal only.

11. The pixel circuit as claimed in claim 1, wherein during a writing period in a frame period, the cross voltage of the first capacitor is related to capacitances of the first and the second capacitors.

12. The pixel circuit as claimed in claim 11, wherein:

a voltage level of the first terminal of the first capacitor is equal to VD, where VD is corresponding to the data signal with a data voltage; and a voltage level of the second terminal of the first capacitor is equal to $VR-Vth+a*(VD-VR)$, where $a=C1/(C1+C2)$, C1 is the capacitance of the first capacitor, C2 is the capacitance of the second capacitor, VR is corresponding to the data signal with a reference voltage, and Vth is a threshold voltage of the third transistor.

13. The display as claimed in claim 6, wherein during a writing period in a frame period, the cross voltage of the first capacitor is related to capacitances of the first and the second capacitors.

14. The display as claimed in claim 13, wherein:

a voltage level of the first terminal of the first capacitor is equal to VD, where VD is corresponding to the data signal with a data voltage; and a voltage level of the second terminal of the first capacitor is equal to $VR-Vth+a*(VD-VR)$, where $a=C1/(C1+C2)$, C1 is the capacitance of the first capacitor, C2 is the capacitance of the second capacitor, VR is corresponding to the data signal with a reference voltage, and Vth is a threshold voltage of the third transistor.

* * * * *